US010301856B2

(12) United States Patent
Hidaka et al.

(10) Patent No.: US 10,301,856 B2
(45) Date of Patent: May 28, 2019

(54) DOOR OPENING AND CLOSING DEVICE FOR VEHICLE

(71) Applicant: KABUSHIKI KAISHA HONDA LOCK, Miyazaki-shi, Miyazaki (JP)

(72) Inventors: Akinori Hidaka, Miyazaki (JP); Takumi Goto, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 0 days.

(21) Appl. No.: 15/113,380

(22) PCT Filed: Dec. 3, 2014

(86) PCT No.: PCT/JP2014/081982
§ 371 (c)(1),
(2) Date: Jul. 21, 2016

(87) PCT Pub. No.: WO2015/118759
PCT Pub. Date: Aug. 13, 2015

(65) Prior Publication Data

US 2017/0009498 A1 Jan. 12, 2017

(30) Foreign Application Priority Data

Feb. 5, 2014 (JP) ..... 2014-020076

(51) Int. Cl.
*E05B 77/34* (2014.01)
*E05B 85/18* (2014.01)
*E05B 15/04* (2006.01)

(52) U.S. Cl.
CPC ..... *E05B 85/18* (2013.01); *E05B 77/34* (2013.01); *E05B 2015/0406* (2013.01); *E05B 2015/0437* (2013.01)

(58) Field of Classification Search
CPC .. E05B 85/18; E05B 77/34; E05B 2015/0437; E05B 2015/0406
See application file for complete search history.

(56) References Cited

U.S. PATENT DOCUMENTS 5,611,224 A * 3/1997 Weinerman ..... E05B 5/00 292/240
6,032,760 A * 3/2000 Jorgensen ..... E05B 15/04 185/40 B (Continued)

FOREIGN PATENT DOCUMENTS

JP 2000-282733 A 10/2000
JP 2002-332767 A 11/2002

(Continued)

OTHER PUBLICATIONS

Office Action issued in the corresponding Chinese patent application 201480074652.8, dated Apr. 27, 2017.

*Primary Examiner* — Kristina R Fulton
*Assistant Examiner* — Thomas L Neubauer
(74) *Attorney, Agent, or Firm* — Carrier Blackman & Associates, P.C.; William D. Blackman; Joseph P. Carrier

(57) ABSTRACT

In a door opening and closing device for a vehicle, a handle case is mounted on an outer panel of a door, an arm portion of an outer handle that can be operated on the door extends through the handle case, penetrates into the outer panel, and is pivotably supported on the handle case, and a return spring is provided between the handle case and a pivoting member that is disposed on the handle case, pivotably supported on the handle case, and operatively linked to the outer handle. The device includes a dust proof wall surrounding a coil portion of the return spring. Accordingly, even when foreign matter enters an interior of the outer panel of the door through a gap between the arm portion of (Continued)

the outer handle and the handle case, it is possible to inhibit foreign matter from being caught in the return spring.

3 Claims, 7 Drawing Sheets

(56) References Cited

U.S. PATENT DOCUMENTS

| | | | |
|---|---|---|---|
| 6,608,265 | B2 | 8/2003 | Shinkawa |
| 8,756,964 | B2 | 6/2014 | Yano et al. |

FOREIGN PATENT DOCUMENTS

| | | | |
|---|---|---|---|
| JP | 4169428 | B2 | 10/2008 |
| JP | 5292386 | B2 | 9/2013 |

* cited by examiner

DOOR OPENING AND CLOSING DEVICE FOR VEHICLE

TECHNICAL FIELD

The present invention relates to a door opening and closing device for a vehicle, in which a handle case is mounted on an outer panel of a door, an arm portion of an outer handle that can be operated on an exterior of the door extends through an opening provided in the handle case, penetrates into the outer panel, and is pivotably supported on the handle case, and a return spring having at least part thereof as a coil portion is provided between the handle case and a pivoting member that is disposed on a back face side of the handle case, pivotably supported on the handle case, and operatively linked to the outer handle.

BACKGROUND ART

A door opening and closing device for a vehicle in which an outer handle is pivotably supported on a handle case mounted on an outer panel of a door, and a torsion spring as a return spring is provided between the handle case and a pivoting member operatively linked to the outer handle within the door and disposed on a back part of the handle case is known in Patent Document 1.

RELATED ART DOCUMENT

Patent Document

Patent Document 1: Japanese Patent No. 4169428

SUMMARY OF THE INVENTION

Problems to be Solved by the Invention

In the arrangement disclosed in Patent Document 1 above, an arm part of the outer handle extends through an opening of the handle case and is inserted into the door, the pivoting member is operatively linked to the arm part, and the torsion spring provided between the pivoting member and the handle case is disposed so as to be exposed. However, when pivoting the outer handle in order to open the door, a gap is formed between the arm part of the outer handle and the handle case, foreign matter such as sand, dirt or the like that has entered through the gap is sometimes caught in the torsion spring, and there is thereby a possibility that the ease of operating the outer handle will be degraded. In particular, compared with a usual passenger vehicle there is a higher possibility of foreign matter entering the interior of a door in the case of a tailgate of a vehicle such as a pickup truck or the like that often runs on bad roads.

The present invention has been accomplished in light of such circumstances, and it is an object thereof to provide a door opening and closing device for a vehicle that can inhibit foreign matter from being caught in a return spring even when the foreign matter enters the interior of an outer panel of a door through a gap between an arm portion of an outer handle and a handle case and that enables the ease of operating the outer handle to be maintained.

Means for Solving the Problems

In order to attain the above object, according to a first aspect of the present invention, there is provided a door opening and closing device for a vehicle, in which a handle case is mounted on an outer panel of a door, an arm portion of an outer handle that can be operated on an exterior of the door extends through an opening provided in the handle case, penetrates into the outer panel, and is pivotably supported on the handle case, and a return spring having at least part thereof as a coil portion is provided between the handle case and a pivoting member that is disposed on a back face side of the handle case, pivotably supported on the handle case, and operatively linked to the outer handle, characterized in that the device comprises a dust proof wall surrounding the coil portion of the return spring.

Further, according to a second aspect of the present invention, in addition to the first aspect, the dust proof wall is formed from part of the handle case and part of a seal member disposed between the handle case and the outer panel.

Effects of the Invention

In accordance with the first aspect of the present invention, even if foreign matter such as sand, dirt or the like enters the interior of the door through a gap formed between the handle case and the arm portion of the outer handle when the outer handle is pivoted in order to open the door, since the coil portion of the return spring is surrounded by the dust proof wall, it is possible to inhibit foreign matter from being caught in the return spring, thereby enabling the ease of operating the outer handle to be maintained.

Furthermore, in accordance with the second aspect of the present invention, since the dust proof wall is formed from the handle case and the seal member, a component exclusively used for the dust proof wall is unnecessary, and any increase in the number of components can be avoided.

EXPLANATION OF REFERENCE NUMERALS AND SYMBOLS

Figure 1:
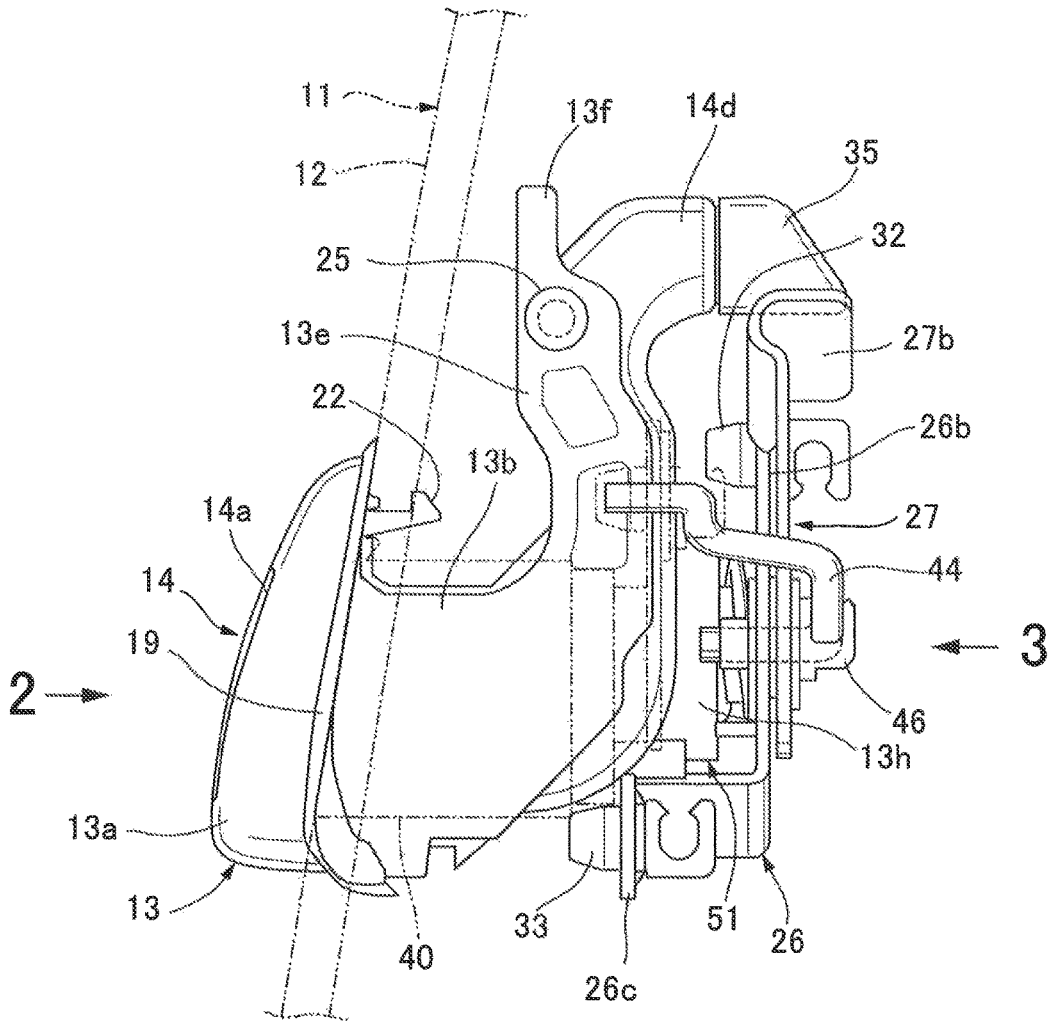
FIG. 1 is a side view of an opening and closing device (first embodiment).
Figure 2:
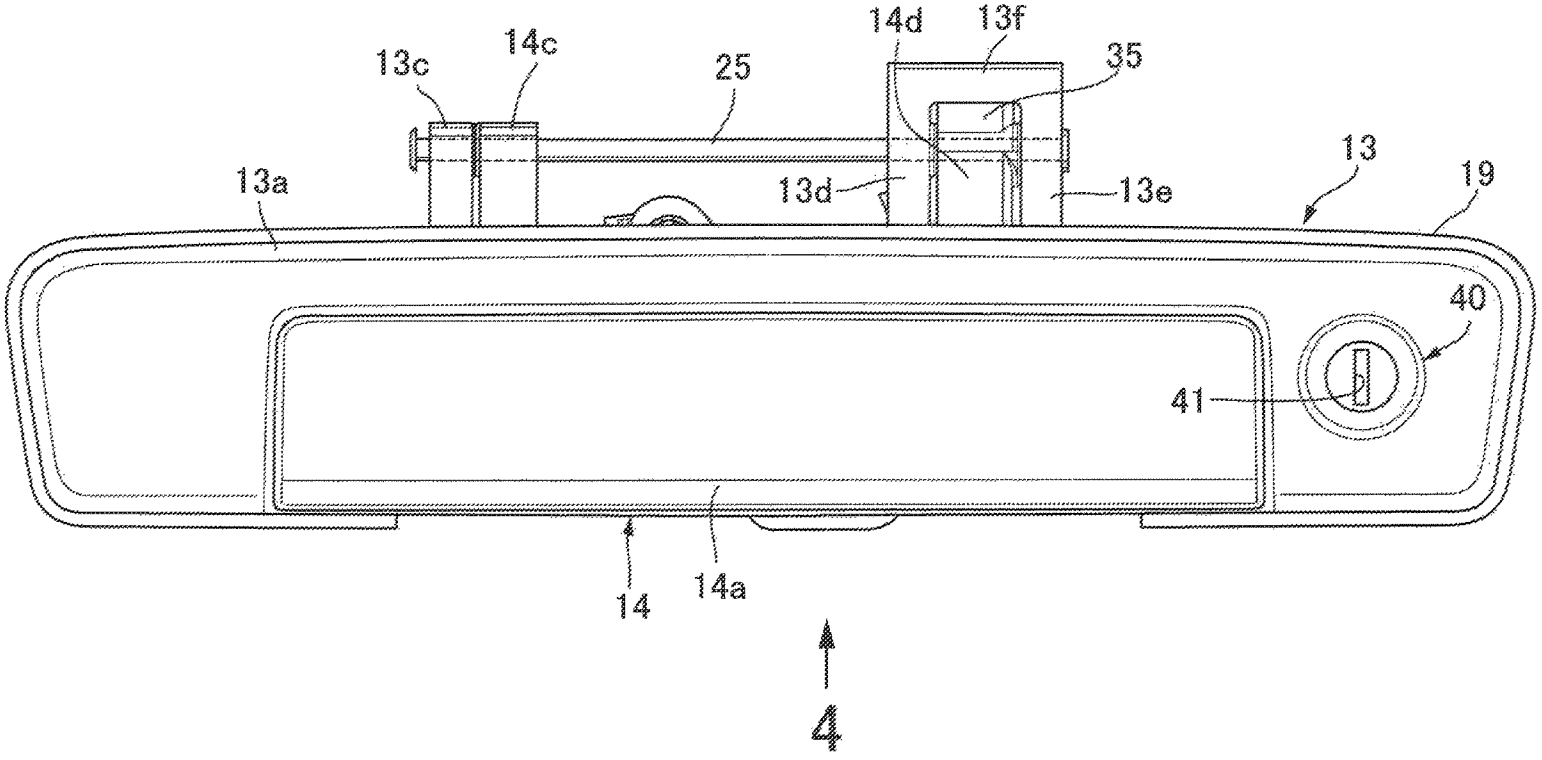
FIG. 2 is an enlarged view from the direction of arrow 2 in FIG. 1 (first embodiment).
Figure 3:
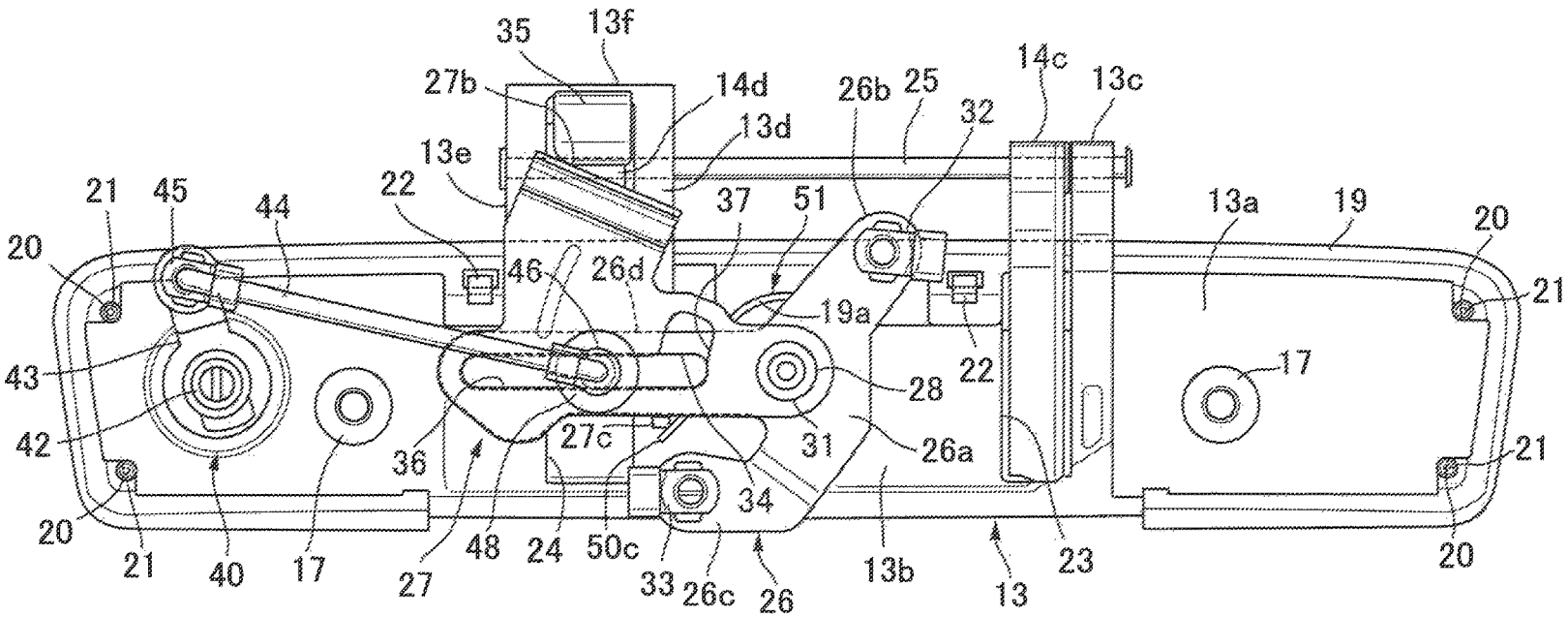
FIG. 3 is an enlarged view from the direction of arrow 3 in FIG. 1 (first embodiment).

11 Tailgate, which is a door
12 Outer panel
13 Handle case
14 Outer handle
14*c*, 14*d* Arm portion
19 Seal member
23, 24 Opening
27 Second lever, which is a pivoting member
50 Return spring
50*a* Coil portion
51 Dust proof wall mode For Carrying Out The Invention An embodiment of the present invention is explained below by reference to the attached FIG. 1 to FIG. 7.

First Embodiment

First, in FIG. 1, an opening and closing device in accordance with the present invention is provided on a tailgate 11 as a door of a four-wheeled vehicle; this opening and closing device includes a handle case 13 mounted on an outer panel 12 of the tailgate 11 and an outer handle 14 pivotably supported on the handle case 13 while enabling it to be operated on the exterior of the tailgate 11.

Referring in addition to FIG. 2 to FIG. 5, the outer handle 14 is for example of a flap type and is formed from a synthetic resin while integrally having a flat rectangular operation portion 14*a*, a protruding portion 14*b* that protrudes from an inner face of an intermediate part in the longitudinal direction of the operating portion 14*a* toward the interior of the door 11 inside of the outer panel 12 while forming, between itself and the operating portion 14*a*, an insertion recess 15 opening downward, so that a hand for gripping and operating the operating portion 14*a*can be inserted thereinto. The outer handle 14 also includes first and second arm portions 14*c* and 14*d* that each have a substantially L-shaped form, and are configured so as to have one end part connectedly provided on opposite sides of the protruding portion 14*b* and extend higher than the operating portion 14*a* and the protruding portion 14*b*.

On the other hand, the handle case 13 is made of a synthetic resin, integrally has a case main portion 13*a* having on an outer face side a pair of shallow recesses 16 housing, in a non-operated state of the outer handle 14, some of the parts of the operating portion 14*a* of the outer handle 14 disposed on opposite sides of the protruding portion 14*b*, and a housing case portion 13*b* projecting from an intermediate part in the longitudinal direction of the case main portion 13*a* toward the interior of the outer panel 12. The handle case 13 is mounted on the outer panel 12 by screwing a bolt (not illustrated), inserted into the outer panel 12 from the inside, into a nut 17 which is embedded in an inner face side of the case main portion 13*a* on opposite sides of the housing case portion 13*b* , and tightening. In a state in which this handle case 13 is mounted on the outer panel 12, the housing case portion 13*b* extends through a through hole (not illustrated) formed in the outer panel 12, and projects into the interior of the door 11 inside of the outer panel Formed in the housing case portion 13*b* so as to be disposed between the pair of recesses 16 formed in the outer face of the case main portion 13*a* is a housing recess 18 housing the protruding portion 14*b* of the outer handle 14 in a non-operated state, this housing recess 18 being formed so as to open downward while making the insertion recess 15 face downward.

A seal member 19 is disposed between the case main portion 13*a* of the handle case 13 and an outer face of the outer panel 12, this seal member 19 being formed into a shape that is disposed between the outer face of the outer panel 12 and a portion, excluding a lower part of the housing case portion 13*b*, of the outer periphery of the case main portion 13*a*. The seal member 19 is mounted on the case main portion 13*a* by means of resilient engagement of a plurality of engagement projections 21 projectingly provided integrally with the case main portion 13*a* being inserted into latching holes 20 formed at a plurality of locations of the seal member 19.

Formed integrally with an upper part of a portion, corresponding to the housing case portion 13*b*, of the seal member 19 are a pair of engagement claws 22 engaging with an upper edge part of the through hole formed in the outer panel 12, the engagement claws 22 being separated from each other.

Provided on opposite sides of the housing case portion 13*b* of the handle case 13 are first and second openings 23 and 24, the first and second arm portions 14*c* and 14*d* integral with the outer handle 14 being inserted through the first and second openings 23 and 24. Provided integrally with the housing case portion 13*b* of the handle case 13 are a first support arm portion 13*c* and second and third support arm portions 13*d* and 13*e*, the first support arm portion 13*c* opposing from the outside a portion, penetrating into the outer panel 12 via the first opening 23, of the first arm portion 14*c* of the outer handle 14, and the second and third support arm portions 13*d* and 13*e* sandwiching from opposite sides a portion, penetrating into the outer panel 12 via the second opening 24, of the second arm portion 14*d* of the outer handle 14. The other end parts of the second and third support arm portions 13*d* and 13*e* are integrally linked via a linking portion 13*f*.

A support shaft 25 is inserted through the extremity of the first support arm portion 13*c*, the other end part of the first arm portion 14*c*, the extremity of the second support arm portion 13*d*, the other end part of the second arm portion 14*d*, and the extremity of the third support arm portion 13*e*. The first and second arm portions 14*c* and 14*d* of the outer handle 14 are pivotably supported on the extremities of the first to third support arm portions 13*c* to 13*e* via the support shaft 25.

Figure 6:
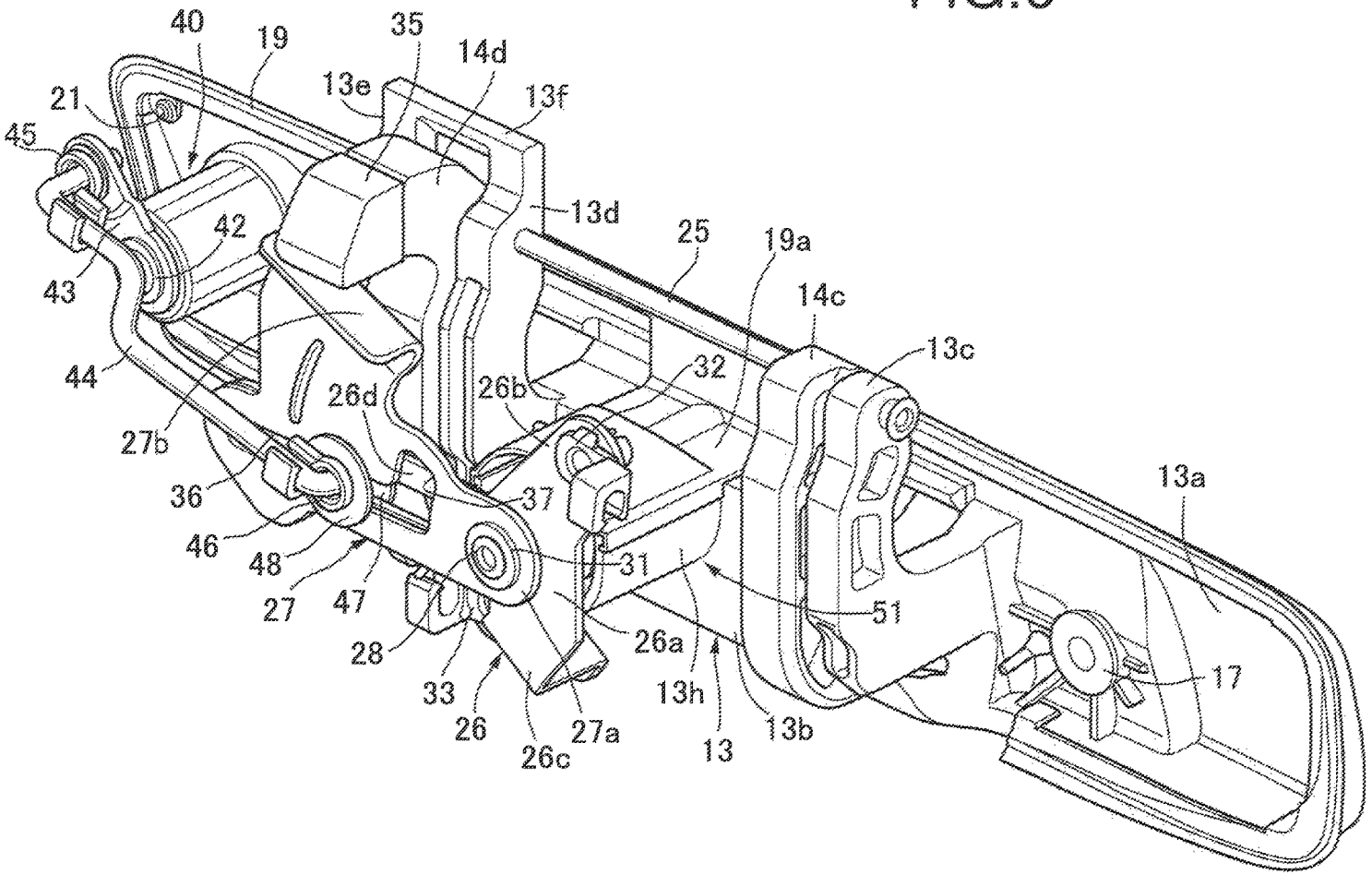
FIG. 6 is a perspective view when the opening and closing device is viewed from the back face side (first embodiment).

Referring in addition to FIG. 6, disposed on a back face side of the housing case portion 13*b* of the handle case 13 are a first lever 26 and a second lever 27 positioned on the side opposite to the housing case portion 13*b* with respect to the first lever 26, parts of the levers 26 and 27 being superimposed on one another.

On the other hand, a support tube portion 13*g* is projectingly provided integrally with an upper part of the housing case portion 13*b* of the handle case 13, and a shaft member 28 is press fitted into the extremity of the support tube portion 13*g*. Pivotably supported on the shaft member 28 are a base portion 26*a* of the first lever 26 having a flange-equipped collar 29 disposed between itself and the shaft member 28, and one end portion 27*a* of the second lever 27 having a first washer 30 disposed between itself and the first lever 26. A projecting end of the shaft member 28 projecting from a second washer 31 having said one end portion 27*a* of the second lever 27 disposed between itself and the first washer 30 is engaged with the second washer 31 by swaging. That is, the first and second levers 26 and 27 are pivotably supported on the handle case 13 via the shaft member 28.

The first lever 26 integrally has the base portion 26*a* pivotably supported by the shaft member 28, a first link arm portion 26*b* extending upward from the base portion 26*a*, a second link arm portion 26*c* extending downward from the base portion 26*a*, and an extending portion 26*d* extending from the base portion 26*a* toward the second and third support arm portions 13*d* and 13*e* side of the handle case 13. Fitted to the extremities of the first and second link arm portions 26*b* and 26*c* are first and second bushes 32 and 33 for pivotably linking a rod (not illustrated) connected to a locking mechanism, which is not illustrated. Furthermore, formed in the extending portion 26*d* is an elongated hole 34 extending along the longitudinal direction thereof.

A pressing portion 14*e* is connectedly provided integrally with the other end part of the second arm portion 14*d* of the outer handle 14 so as to be bent into a substantially L-shaped form, and a pressure-receiving portion 27*b* abutting, from below, against a cap 35 made of a resin fitted onto the pressing portion 14*e* is provided integrally with the second lever 27. Furthermore, formed in the second lever 27 are an elongated hole 36, corresponding to the elongated hole 34 of the first lever 26, and an arc hole 37 that has an arc-shaped form with the central axis of the shaft member 28 as the center and extends upward from an end part, on the shaft member 28 side, of the elongated hole 36.

Moreover, a cylinder lock 40 is mounted on the case main portion 13*a* of the handle case 13 at a position where the second and third support arm portions 13*d* and 13*e* of the handle case 13 are sandwiched between the cylinder lock 40 and the shaft member 28 so that a key hole 41 faces the outer face of the case main portion 13*a*, a third lever 43 has one end part linked to an inner end part of a rotor 42 belonging to the cylinder lock 40, and one end part of a rod 44 is pivotably linked to the other end part of the third lever 43 via a third bush 45.

On the other hand, a fourth bush 46 inserted through the elongated hole 34 formed in the extending portion 26*d* of the first lever 26 and the elongated hole 36 of the second lever 27 is engaged with third and fourth washers 47 and 48 sandwiching the extending portion 26*d* of the first lever 26 and the second lever 27 therebetween, and the other end part the rod 44 is pivotably linked to the fourth bush 46.

In a locked state of the cylinder lock 40, the rotor 42 and the third lever 43 are at a pivoting position where the fourth bush 46 is positioned in end parts, on the shaft member 28 side, of the elongated holes 34 and 36, and when in this state the outer handle 14 is pivoted so as to pivot the second lever 27 around the central axis of the shaft member 28, only the position of the fourth bush 46 within the arc hole 37 of the second lever 27 changes, the pivoting driving force is not transmitted to the first lever 26, and the first lever 26 remains stationary. On the other hand, when the cylinder lock 40 is unlocked by means of a key, which is not illustrated, the rotor 42 and the third lever 43 are at a pivoting position where the fourth bush 46 is positioned on end parts, on the side opposite to the shaft member 28, of the elongated holes 34 and 36, and when in this state the outer handle 14 is pivoted so as to pivot the second lever 27 around the central axis of the shaft member 28, the pivoting driving force is transmitted to the first lever 26 via the fourth bush 46, and the first lever 26 is pivoted. This enables a force to release a locked state of the locking mechanism to be transmitted thereto.

Figure 7:
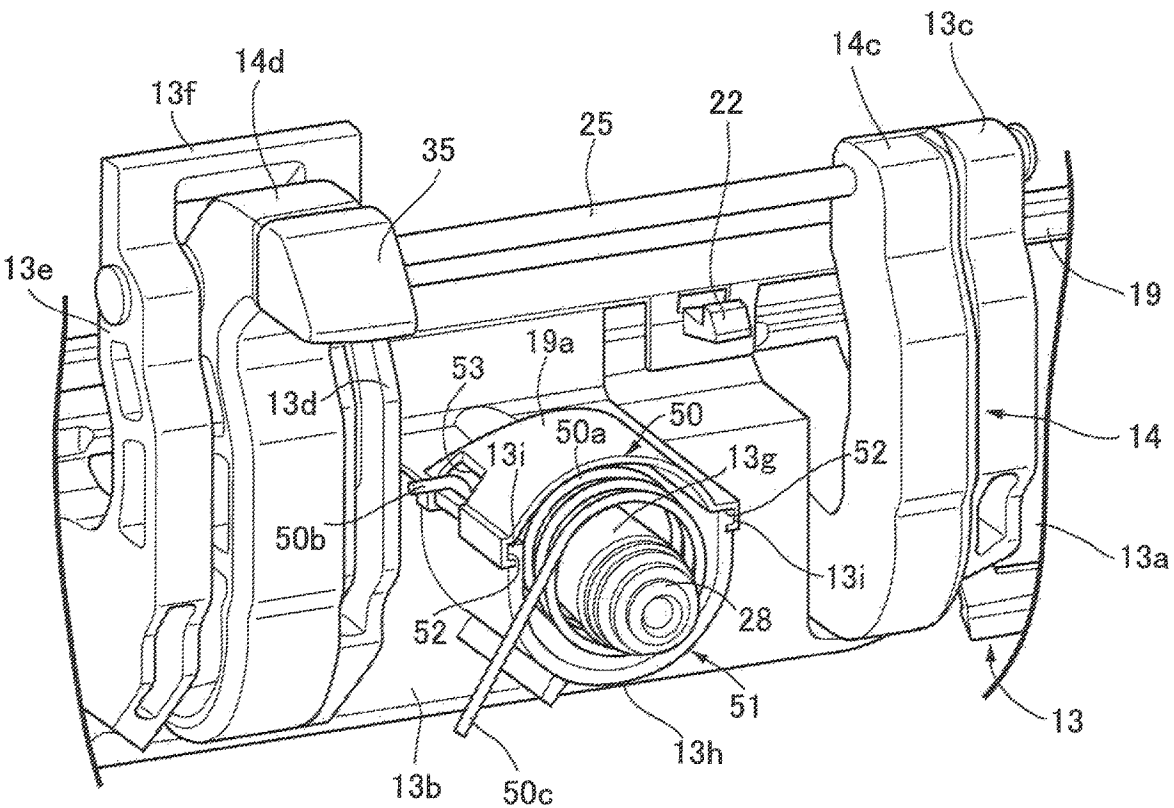
FIG. 7 is a perspective view of an area around a return spring in a state in which first and second levers are omitted (first embodiment).

Referring in addition to FIG. 7, a return spring 50 having a coil portion 50*a* in at least part thereof is provided between the second lever 27 as a pivoting member operatively linked to the outer handle 14 and the housing case portion 13*b* of the handle case 13, and in this embodiment the return spring 50, which is a torsion spring, is provided between the second lever 27 and the housing case portion 13*b*. The spring force exhibited by the return spring 50 urges the outer handle 14 toward a non-operated position side via the second lever 27.

The return spring 50 has the coil portion 50*a* surrounding the support tube portion 13*g* provided on the handle case 13, a first engagement piece 50*b* extending from the coil portion 50*a*, and a second engagement piece 50*c* extending from the other end of the coil portion 50*a* , the first engagement piece 50*b* being engaged with the handle case 13 side, and the second engagement piece 50*c* being engaged with a latching projecting portion 27*c* projectingly provided integrally with a lower part of the second lever 27.

The coil portion 50*a* of the return spring 50 is surrounded by a dust proof wall 51, this dust proof wall 51 being formed from part of the handle case 13 and part of the seal member 19 disposed between the handle case 13 and the outer panel 12. In this embodiment, projectingly provided integrally with the housing case portion 13*b* of the handle case 13 is a lower cover portion 13*h* having a substantially U-shaped cross-section opening upward so as to cover from below the coil portion 50*a* surrounding the support tube portion 13*g* , and provided integrally with the seal member 19 is an upper cover portion 19*a* forming, together with the lower cover portion 13*h*, the dust proof wall 51, the upper cover portion 19*a* having an arc-shaped cross-section opening downward.

Projectingly provided integrally with upper parts at opposite ends in the peripheral direction of the lower cover portion 13*h* are projecting portions 13*i* projecting sideways, and formed on inner faces of lower parts at opposite ends in the peripheral direction of the upper cover portion 19*a* are latching grooves 52 each having the projecting portion 13*i* engaged therewith. Engaging the projecting portion 13*i* with the latching groove 52 joins the lower cover portion 13*h* and the upper cover portion 19*a* to each other, thus forming the dust proof wall 51.

A cutout 53 is provided in a portion, corresponding to one end of the coil portion 50*a* surrounding the support tube portion 13*g*, of the upper cover portion 19*a*, the first engagement piece 50*b* extending through the cutout 53, and the first engagement piece 50*b* projecting from the cutout 53 being engaged with the lower cover portion 13*h* of the handle case 13. Moreover, the other end part of the coil portion 50*a* is further outside than the extremity of the dust proof wall 51, and the second engagement piece 50*c* connected to the other end part of the coil portion 50*a* is engaged with the latching projecting portion 27*c* of the second lever 27.

Figure 4:
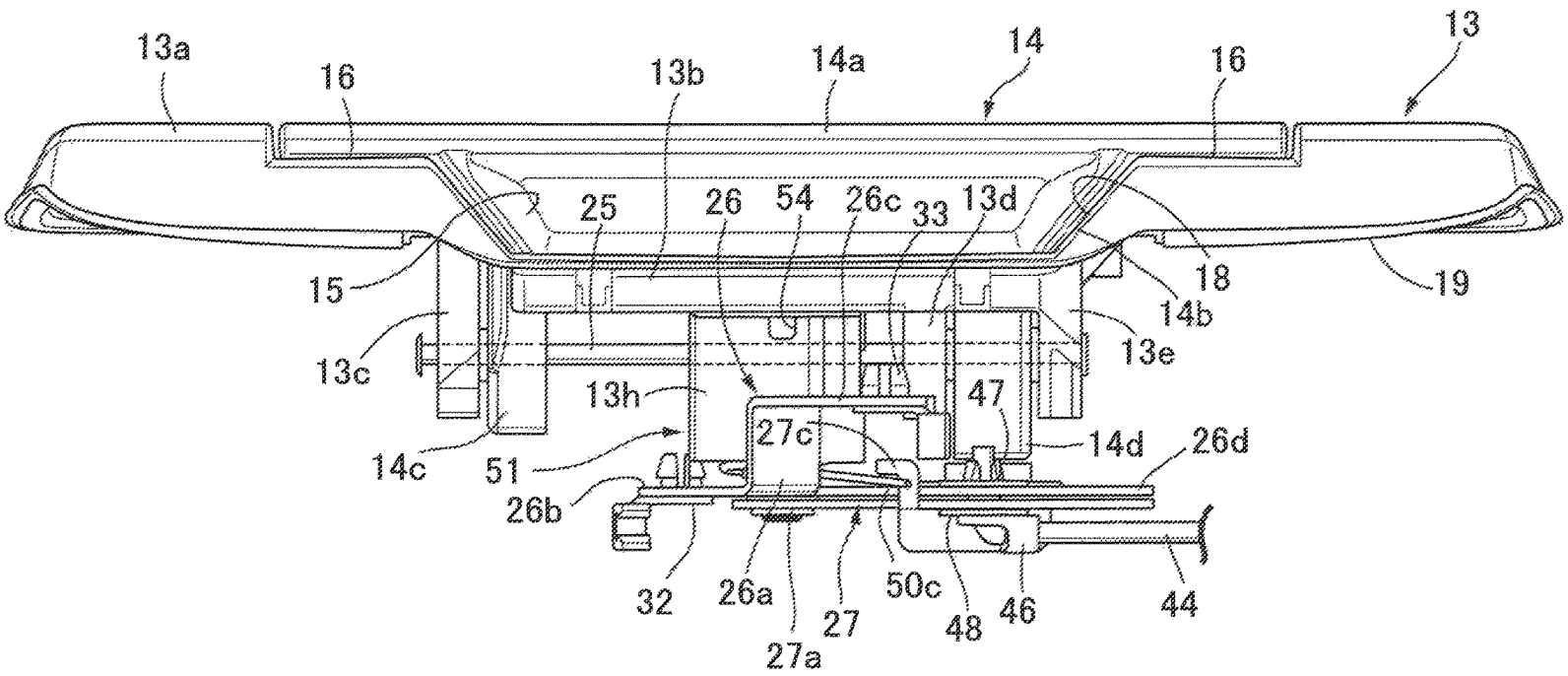
FIG. 4 is a view in the direction of arrow 4 in FIG. 2 (first embodiment).
Figure 5:
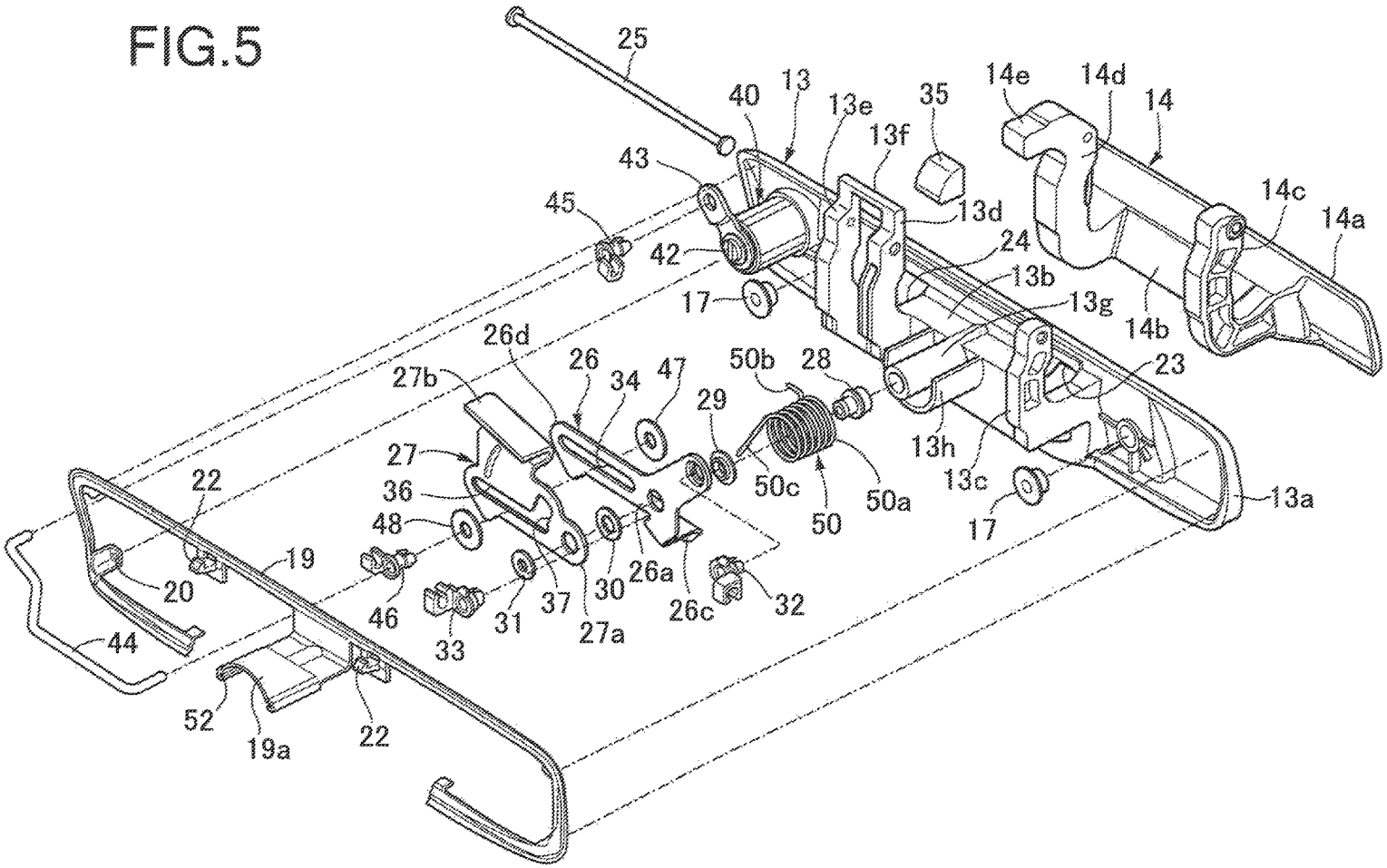
FIG. 5 is an exploded perspective view of the opening and closing device (first embodiment).

Furthermore, as shown in FIG. 4, a drain hole 54 for draining water that has entered the interior of the dust proof wall 51 is provided in a lower part of the lower cover portion 13*h*.

The operation of this embodiment is now explained. Since the return spring 50 having the coil portion 50*a* in at least part thereof, in this embodiment the return spring 50, which is a torsion spring, is provided between the handle case 13 and the second lever 27 disposed on the back face side of the handle case 13 so as to be pivotably supported on the handle case 13 and operatively linked to the outer handle 14, and the coil portion 50*a* of the return spring 50 is surrounded by the dust proof wall 51, it is possible to prevent foreign matter such as sand, dirt or the like from being caught in the return spring 50 even if it enters the interior of the tailgate 11 through a gap formed between the handle case 13 and the first and second arm portions 14*c* and 14*d* of the outer handle 14 when the outer handle 14 is pivoted in order to open the tailgate 11, thereby enabling the ease of operating the outer handle 14 to be maintained.

Furthermore, since the dust proof wall 51 is formed from part of the handle case 13 and part of the seal member 19 disposed between the handle case 13 and the outer panel 12, a component exclusively used for the dust proof wall 51 is unnecessary, and any increase in the number of components can be avoided.

An embodiment of the present invention is explained above, but the present invention is not limited by the embodiment and may be modified in a variety of ways as long as the modifications do not depart from the spirit and scope thereof.

For example, in the embodiment, an opening and closing device provided on the tailgate 11 is explained, but the present invention may be applied to a door of another vehicle such as a side door of a passenger vehicle, or the like.

The invention claimed is:

1. In a vehicle having a vehicle body with a door which is pivotally mounted thereon, the improvement comprising a door opening and closing device for the vehicle door, said door opening and closing device comprising:

a handle case mounted on an outer panel of the door, the handle case comprising a support tube, a pivoting member disposed on an inner face side of the handle case in relation to the outer door panel, an outer handle having an operating portion that is situated on an exterior of the door, at least one arm portion attached to the outer handle operating portion, wherein the one arm portion extends through an opening provided in the handle case, penetrates through the outer panel, and wherein the outer handle is pivotably supported on the handle case, a return spring, having at least part thereof as a coil portion, provided between the handle case and the pivoting member that is disposed on the inner face side of the handle case, the pivoting member being pivotably supported on the support tube of the handle case, and operatively linked to the outer handle, wherein the device comprises a substantially cylindrical dust-resistant wall surrounding the coil portion of the return spring, said dust-resistant wall including a lower cover portion proximate the support tube, and an upper cover portion joined to the lower cover portion.

2. The door opening and closing device for a vehicle according to claim 1, wherein a first portion comprising the lower cover portion of the dust-resistant wall is formed from part of the handle case, and a second portion comprising the upper cover portion of the dust-resistant wall is formed from part of a seal member disposed between the handle case and the outer panel.

3. In a vehicle having a vehicle body with a door which is pivotally mounted thereon, the improvement comprising a door opening and closing device for the vehicle door, said door opening and closing device comprising:

a handle case mounted on an outer panel of the door, the handle case comprising a cylindrical support tube, a first lever disposed on an inner face side of the handle case in relation to the outer door panel, the first lever being pivotally mounted on the support tube, an outer handle having an operating portion that is situated on an exterior of the door, at least one arm portion attached to the outer handle operating portion, wherein the one arm portion extends through an opening provided in the handle case, penetrates through the outer panel, and is pivotably supported on the handle case, a return spring, having at least part thereof as a coil portion surrounding the support tube of the handle case, the first lever being operatively linked to the outer handle, and a second lever pivotally mounted to the support tube, wherein the device comprises a substantially cylindrical dust-resistant wall surrounding the support tube and the coil portion of the return spring; and wherein a first portion of the dust-resistant wall is formed from part of the handle case proximate the support tube, and a second portion of the dust-resistant wall is formed from part of a seal member disposed between the handle case and the outer panel.

* * * * *